US005805039A

United States Patent [19]

Smith

[11] Patent Number: 5,805,039

[45] Date of Patent: Sep. 8, 1998

[54] POLARIZED ELECTROMAGNETIC RELAY

[75] Inventor: Daniel Robert Smith, Fort Branch, Ind.

[73] Assignee: Siemens Electromechanical Components, Inc., Princeton, Ind.

[21] Appl. No.: 512,009

[22] Filed: Aug. 7, 1995

[51] Int. Cl.[6] ..... H01H 51/22

[52] U.S. Cl. ..... 335/78; 335/80

[58] Field of Search ..... 335/78–86, 124, 335/128

[56] References Cited

U.S. PATENT DOCUMENTS

| | | | |
|---|---|---|---|
| 4,703,293 | 10/1987 | Ono et al. | 335/78 |
| 5,153,543 | 10/1992 | Hitachi et al. | 335/78 |
| 5,587,693 | 12/1996 | Fear . | |

FOREIGN PATENT DOCUMENTS

| | | |
|---|---|---|
| 0 197 391 A | 10/1986 | European Pat. Off. . |
| 0 293 199 A | 11/1988 | European Pat. Off. . |
| 10 10 640 B | 6/1957 | Germany . |
| 21 48 377 A | 4/1973 | Germany . |
| 89 09 467 U | 12/1990 | Germany . |
| 40 19 236 A | 6/1991 | Germany . |

*Primary Examiner*—Lincoln Donovan
*Attorney, Agent, or Firm*—Joseph S. Codispoti; Donald B. Paschburg

[57] ABSTRACT

A polarized electromagnetic relay includes a base, an electromagnet with a coil and a pair of pole pieces extending perpendicularly from the end of said coil, a balanced armature and spring system which when actuated pivots between two fixed contact points and a permanent magnet inducing the same magnetic poles in both of said pole pieces and providing an opposite pole in closely adjacent relationship to the central portion of the armature. A movable contact spring is fixedly connected to the armature, said spring forming contact arms at either armature end portion. Further, a flexible movable braid connects the movable contacts on said movable spring to each other and to a movable contact terminal. A pair of retaining tabs extending from a central bobbin flange engaging corresponding recesses at the lateral sides of the armature limits the movement of the armature in two directions as well as its rotation. This feature eliminates the need for a torsion spring and allows the contact forces to be higher if necessary. Two identical coils wound in a common direction are provided as the means for actuation. Armature transfer will occur by either applying a voltage pulse across the appropriate coil, or by toggling the voltage pulse polarity across the two coils connected in series.

21 Claims, 4 Drawing Sheets

POLARIZED ELECTROMAGNETIC RELAY

TECHNICAL FIELD OF THE INVENTION

The present invention relates to a polarized electromagnetic relay, featuring a balanced armature and spring system which when actuated, rotates between two fixed contact points.

BACKGROUND OF THE INVENTION

Polarized electromagnetic relays with a swingable armature pivoted at its center are known, for example, as disclosed in U.S. Pat. No. 4,695,813. This known design comprises a center pivoted armature resting atop a permanent magnet which spans two interconnected pole pieces. In this known relay, the balanced armature is connected to a pair of movable contact springs each being formed with a transversely extending torsion pivot arm which is fixedly connected to a portion of a casing. In particular, the pivot arms serve as electrical connections for the respective contact springs and are connected to respective terminals mounted on the casing.

This design approach has been implemented in relays best suited for applications containing relatively low load currents, such as telecommunication equipment. At such levels, the connection between the movable contacts and the movable terminal can be made via a current carrying spring member. However, due to the pivoting motion of the armature, the spring must be designed to be sufficiently pliable to prevent the generation of excessive torsion forces, as well as to prevent fatigue related failures. As a result, the connecting spring member must be designed with a relatively small cross section area, thus limiting its current carrying capacity. That means, the torsion pivot arms of the known relay are not capable of conducting power currents as occur in automotive or general purpose applications; in addition, said pivot arms reduce the contact forces resulting from the attraction exerted by the permanent magnet onto the armature.

SUMMARY OF THE INVENTION

The principal objective of this invention is to produce a polarized electromagnetic latching relay capable of carrying steady state currents of higher levels, for example in excess of 30 amperes.

It is a further object of the present invention to provide a polarized electromagnetic relay having a balanced armature, wherein the armature bearing is designed in such a manner to prevent excessive armature motion during severe shock conditions, as well as during the magnetization process.

It is a still further object of the present invention to provide a polarized electromagnetic relay in which the contact spring and bearing functions are separated from the load current conducting function for the movable contacts, so as to provide excellent shock resistent characteristics of the balanced armature design and optimal spring characteristics for providing a desired contact force, while the torsion forces generated by a separate conductive element are minimized.

It is another object of the present invention to provide a polarized relay with a balanced armature and spring system wherein the balancing armature is supported on the bobbin, without the need of additional pivot arms, thus providing a small number of parts, simple assembling steps and exact adjustment of the armature with respect to the coil, permanent magnet and pole pieces.

It is still another object of the present invention to provide a polarized electromagnetic relay which can be built for either a single or dual input, where in the single input version a single coil supply is used to operate the relay by reversing coil polarity, while in the dual input two separate coil voltage sources are used to operate the relay.

These and other objects are achieved by the present invention which provides a polarized electromagnetic relay comprising:

an insulating base defining a bottom plane;

an electromagnet block on the base including a bobbin having a pair of end flanges and a center flange, a pair of coils being wound about said bobbin between either one of said end flanges and said center flange, a common axis of said bobbin and coils extending parallel to said bottom plane, a core extending axially through said bobbin and coils, and a pair of pole pieces extending perpendicular from either core end, each adjacent to a respective end flange;

an elongate armature balanced with its central portion to be movable about a central rotation axis for angular movement between two contact operating positions, either end portion of the armature on either side of the rotation axis defining a air gap with one of said pole pieces;

a permanent magnet coupled magnetically between said core and said armature so as to induce the same magnetic poles in both said pole pieces and to provide an opposite pole in closely adjacent relationship to said central portion of the armature;

at least one movable contact spring fixedly connected to the armature at a portion intermediate the ends thereof and being formed with contact arms in the vicinity of either armature end portion, said contact arms carrying movable contacts to be moved according to the armature movement in and out of contact with corresponding fixed contacts mounted on said base; and a conductor connecting said contact arms with a movable contact terminal mounted on said base, wherein said armature is provided with a pair of recesses extending from either lateral side in opposite directions along the rotation axis and a pair of retaining tabs are formed on said central flange of the bobbin projecting on either side of the armature, either one of said tabs fitting in a corresponding one of that recesses of the armature and projecting beyond the armature thickness so as to limit movement of the armature in two directions as well as rotation about the rotation axis.

According to the invention, the relay may be constructed having more than one movable spring to form e.g. a double-pole relay, wherein a pair of contact springs would be mounted on the armature having insulation with respect to each other and to the armature. However, in a preferred embodiment only one single contact spring having a pair of contact arms is fixedly connected to the armature without a need of insulation therebetween. In this case, the whole structure of the relay is quite simple with only two fixed contact terminals and one movable contact terminal, which can be mounted in the base as simple bar-shaped terminal members extending perpendicular to the bottom plane.

Since the contacts are connected directly via a conductor with each other and to the movable contact terminal, the movable spring which is made preferably in one piece with the pivot arms can be designed merely with respect to excellent spring properties so as to provide the desired contact forces. The movable spring is made preferably from a material having excellent resilience, such as stainless steel, but may have poor conductivity.

Advantageously, the invention provides that the armature is balanced on the permanent magnet in the region of the center flange of the bobbin and is retained by a pair of tabs of the bobbin engaging recesses in the armature. Thus, the relay system can dispense with resilient pivot arms, and the movable contact spring can be designed simpler and needs less work in manufacturing and assembling. The armature is retained in two directions by the tabs of the bobbin, while it is retained in the third direction by the attraction force of the permanent magnet. In case of extreme shocks, additional protection against excessive armature motion can be provided by the fixed contact terminals when the end portions of the armature are each disposed between the bobbin and a corresponding fixed contact terminal.

Preferably, the permanent magnet consists of a bar-shaped or plate-shaped three-pole magnetized permanent magnet disposed between the free ends of the pole pieces, which magnet is magnetized to have the same poles at its lengthwise ends adjacent to the pole pieces and to have the opposite pole intermediate its ends adjacent to a central portion of the armature which is balanced upon this pole.

Alternatively, a plate-shaped or bar-shaped, two-pole permanent magnet may be provided, which is arranged in said center flange of the bobbin perpendicular to the axis of said core and coils, that magnet being coupled with one pole to said core and presenting the opposite pole to the armature which is balanced thereon.

BRIEF DESCRIPTION OF THE DRAWINGS

For a better understanding of the invention, reference is made to the following description of an exemplary embodiment thereof, and to the accompanying drawings, wherein.

DETAILED DESCRIPTION

Figure 1:
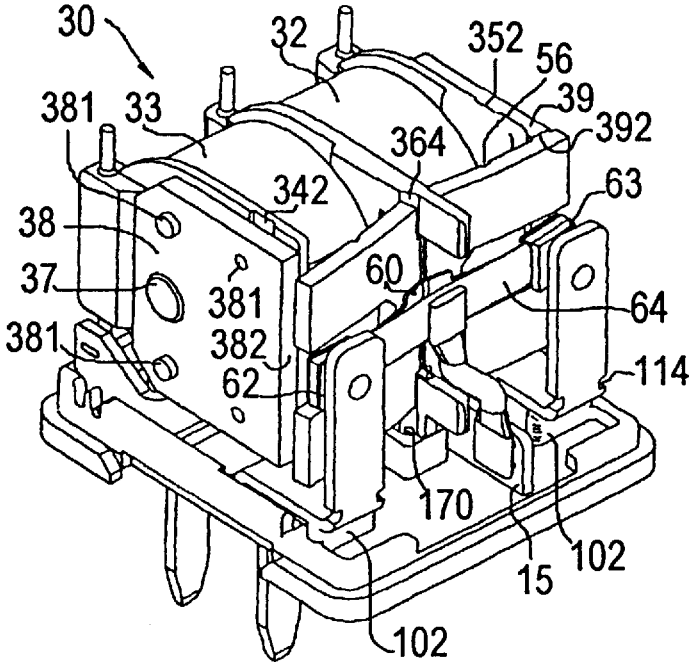
FIG. 1 is a perspective view of a polarized relay constructed in accordance with the present invention.
Figure 2:
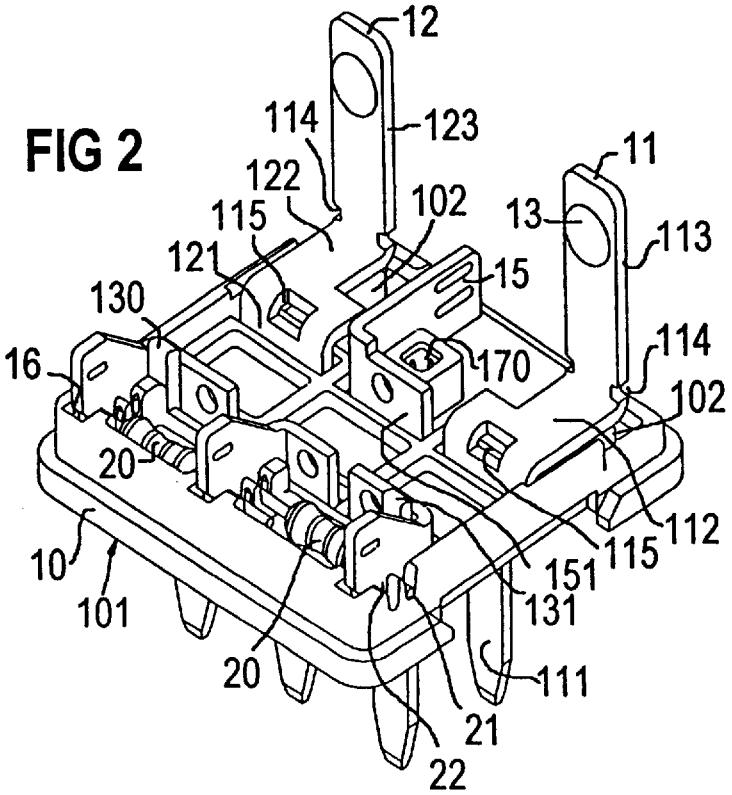
FIG. 2 is a perspective view of a base unit of the relay shown in FIG. 1.
Figure 3:
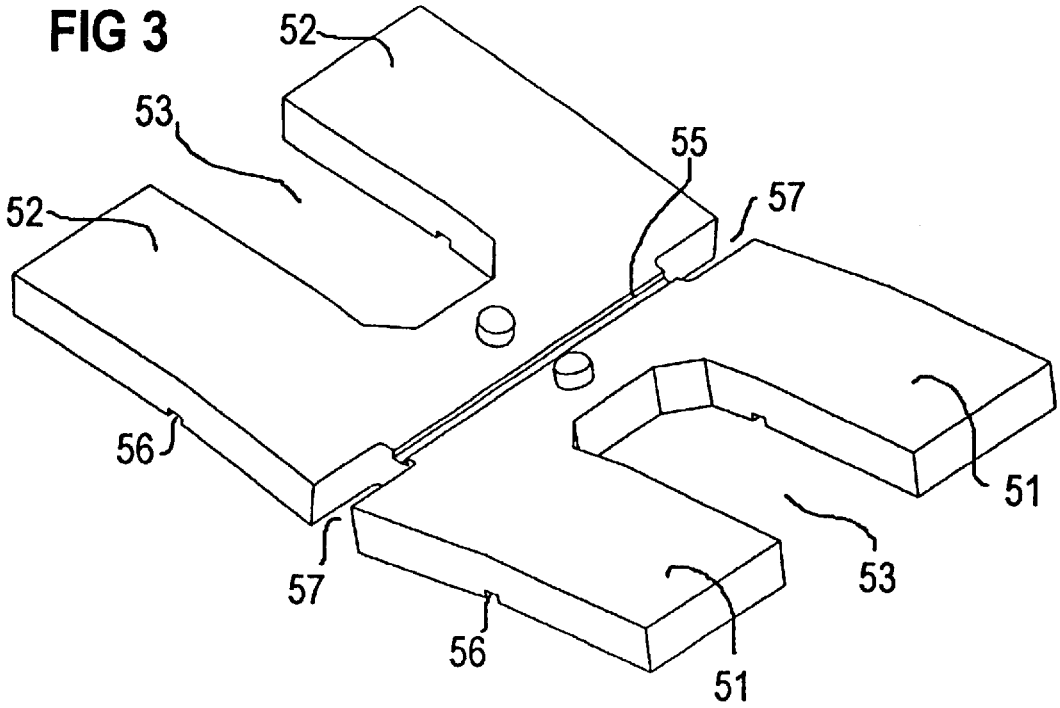
FIG. 3 is a perspective view of an armature in the relay of FIG. 1.
Figure 4:
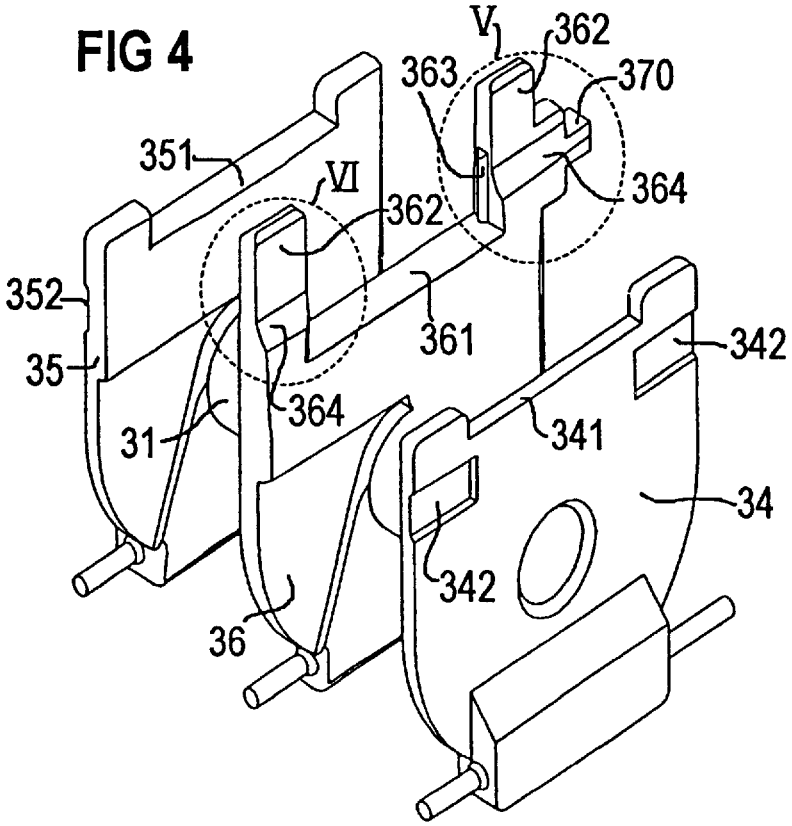
FIG. 4 is a perspective view of a bobbin in the relay of FIG. 1.
Figure 5:
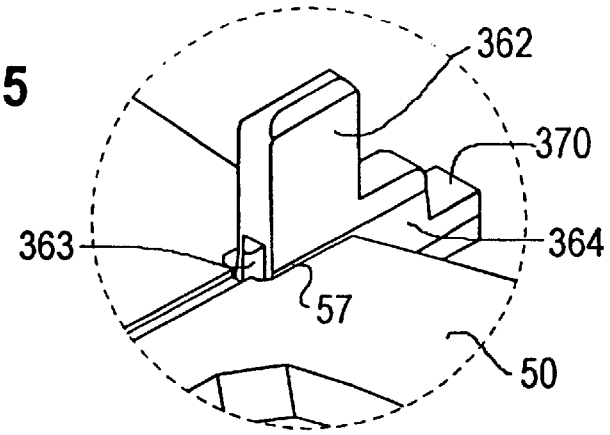
FIGS. 5 and 6 are enlarged details V and VI, respectively, in FIG. 4, including the respective armature parts of FIG. 3.
Figure 6:
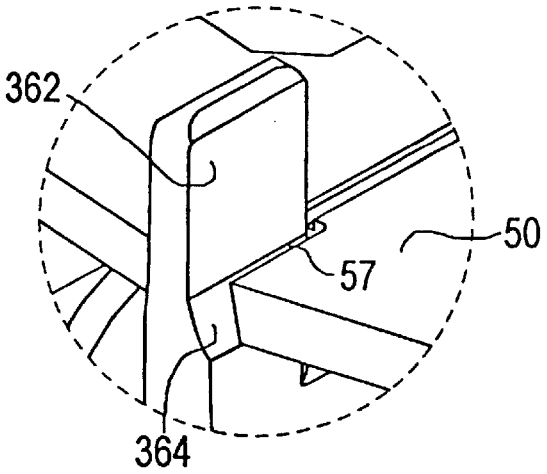

Referring now to FIGS. 1 to 8, there is shown a polarized electromagnetic relay of the present invention. The relay is of bistable operation and of single-pole double-throw contact arrangement. The relay comprises a base 10 of insulating material which defines a base or bottom plane 101 for the relay. A pair of stationary or fixed contact terminals 11 and 12 are fastened in the insulating base 10. Each of these fixed terminals 11 and 12 has a plug section 111 and 121, respectively, anchored in the base perpendicular to the base or bottom plane defined by the lower surface 101 of the base, an intermediate section 112 and 122, respectively, which is bent approximately parallel to the base plane and a contact carrying section 113 and 123, respectively, extending perpendicular to the base plane and carrying fixed contacts 13 and 14. The intermediate sections 112 and 122 have a bias angle of less than 90° to ensure that the terminal near the bend of the contact carrying section 113 or 123 will always be in contact with a subjacent area 102 of the base. This combination reduces the sensitivity of external bending of the plug sections 111 and 121. The feature enables the load terminals 11 and 12 to withstand larger external bending forces exerted on the plug sections 111 and 121 without influencing the overtravel and air gap at the contact carrying sections 113 and 123.

The bottoms of the contact carrying sections 113 and 123 are provided with stress concentration notches 114 to aid the adjustment of the relay. The notches 114 provide a precise bend location. This will give the assembly equipment repeatable results. Further, a cutout 115 is provided in the bending area between the plug sections 111 and 121, respectively, and the intermediate sections 112 and 122, respectively, which cutout gives the assembly equipment a backup for the terminal during the staking process. This allows for a more optimized terminal layout reducing the material scrap.

The movable contact terminal 15 is disposed in the base 1, with a plug section 151 being anchored in the base parallel to the plug sections 111 and 112. Further, coil terminals 17 and 18 and a common coil terminal 19 are fastened in the base 10 in a similar manner; all the terminals are inserted into slots 16 in the base 10 and are fixed by caulking or by any other suitable sealant or method. A pair of suppression resistors 20 or other components may be arranged on the base 10 and connected to the coil terminals 17, 18 and 19 by clamping their wires between clamping nuts 21 in the base and fork-like clamping claws 22 of the respective coil terminals. In a single input version, the common coil terminal 19 as well as one of the suppression resistors 20 may be omitted.

An electromagnet block 30 arranged on the base 10 comprises a bobbin 31 with a pair of coils 32 and 33 wound thereon between end flanges 34 and 35 and a center flange 36. An iron core 37 of cylindrical shape is inserted axially into the bobbin and coils and is coupled at its ends to a pair of plate-like pole pieces 38 and 39 which rest against the end flanges 38 and 39 and are provided with through holes corresponding in the diameter to the coil 37. Preferably, the pole pieces 38 and 39 are laser welded to the ends of the core 37.

A plate-like elongate permanent magnet 40 is disposed along one lateral side of the bobbin in a plane perpendicular to the base plane and bridging the end flanges 34 and 35 as well as the pole pieces 38 and 39. The permanent magnet 40 is seated in recesses 341, 351 and 361 of the end flanges 34 and 35 and of the center flange 36, respectively. The permanent magnet 40 is magnetized in a three-pole manner so as to have the same magnetic poles (south poles S) at both ends and the opposite pole (north pole N) in its center. Preferably, the pole pieces 38 and 39 are laser welded to the ends of the core 37 as well as to the ends of the permanent magnet 40. This process eliminates a possibility of bending the pole pieces toward the center of the relay and crushing internal coil windings during a process such as staking. In the welding process, the pole pieces are held against the magnet, and the magnet is aligned to the pole face areas; then the laser welder welds the magnet to the corresponding pole piece. With the core to pole piece position already established, the laser welds also either core end to the respective pole piece.

An elongate, plate-like armature 50 which is slightly bent into a V-shape, is balanced on the center pole N of the permanent magnet 40 so as to form air gaps between its end portions and either one of the pole pieces 38 and 39. Either end of the armature is divided into a pair of legs 51 and 52, respectively, by means of recesses 53 and 54, respectively. In particular, the central part of the armature 50 is bent into a V-shape about a central, axial groove 55 so as to form a fulcrum on the side opposite the groove 55 for rotating on the surface of the permanent magnet 40. The armature legs 51 and 52 are bent slightly in an opposite direction towards the corresponding pole pieces to provide an area contact between the armature legs and the pole pieces. The grooves 55 and 56 ensure that the critical angles are achieved exactly as wanted.

In its axial area, the armature 50 is provided with a pair of recesses 57 extending from each lateral side along the rotation axis of the armature. The remaining width of the armature between the recesses 57 corresponds to the width between a pair of retaining tabs 362 extending from the center flange 36 of the bobbin 31. These retaining tabs 362 limit the movement of the armature into two directions as well as the rotation of the armature. Each of the tabs 362 is provided with a narrow rib 363 facing the armature edge at the inner end of the recesses 57. These ribs 363 (see FIGS. 4, 5 and 6) reduce the side to side motion while they minimize the rotational friction.

Figure 7:
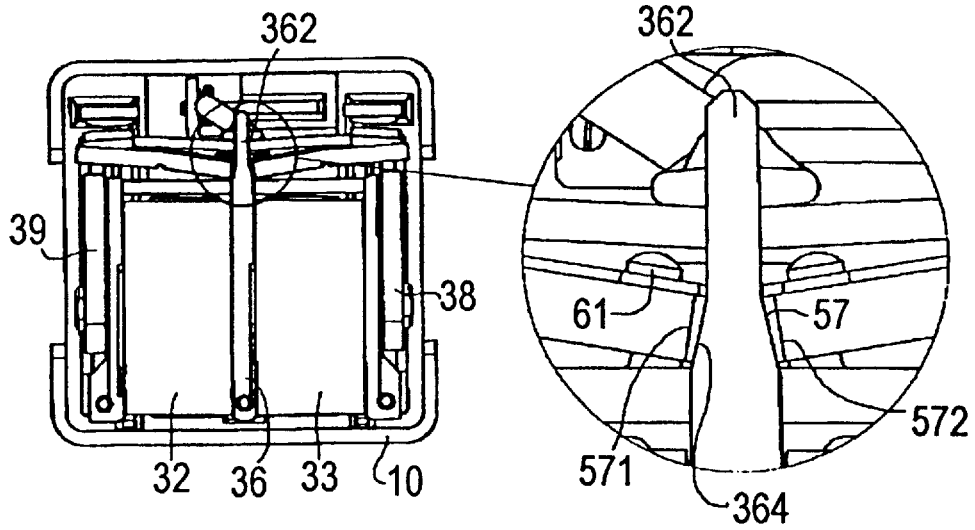
FIG. 7 is a top view of the relay of FIG. 1 with a balanced armature position with an enlarged detailed view of the armature retaining feature.
Figure 8:
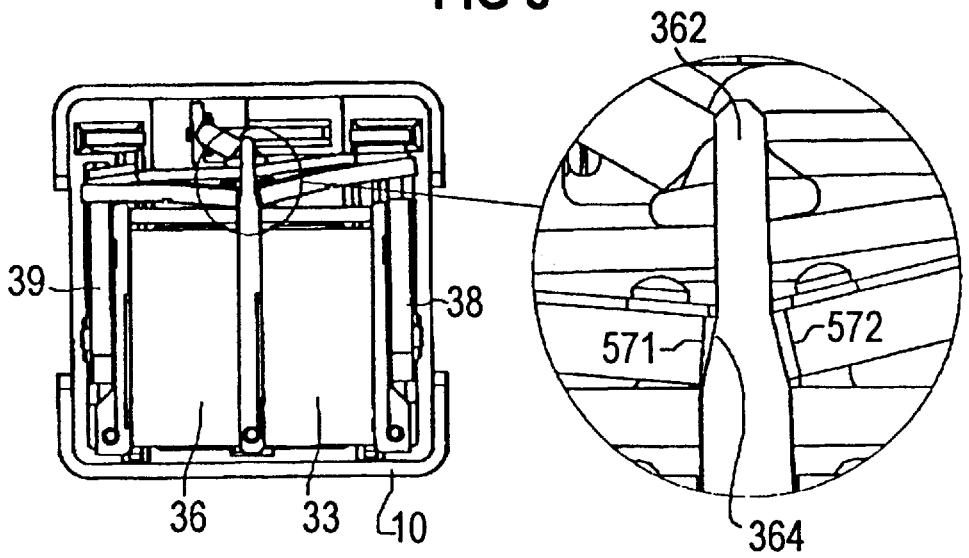
FIG. 8 is a top view of the relay of FIG. 1 with the armature being in one energized position, together with an enlarged view of the armature retaining feature.

Further, each of the tabs 362 has a tapered section 364 engaging the corresponding recess 57 of the armature that match the respective angle of the armature so as to prevent the armature from binding in the bobbin yet maintaining the desired position. The respective angles are visible in FIGS. 7 and 8 in a side view and in detail. FIG. 7 shows the armature 50 in a balanced position, where the edges 571 and 572 of the recess 57 have a small distance on both sides of the tapered section 364. FIG. 8 shows the armature in an end position resting on the left pole piece 38. In this case, the lower end of the edge 571 butts against the tapered section 364, while the opposite edge 572 is essentially parallel to the tapered section 364. With this design, the armature can freely rotate at the predetermined switching angle without unwanted friction or binding. The height of the tabs 362 prevents the armature from falling off the motor structure when high shock conditions occur. The tabs have ample lead-in to aid assembly. Generally, the tabs 362 eliminate the need for a torsion spring. This allows the contact forces to be higher than in other relays where resilient pivot arms reduce the attraction force generated by the permanent magnet.

Proximate to one of the retaining tabs 362, the bobbin 31 has a post 370 that extends from the center flange 36. The post 370 is configured to be received by a corresponding aperture 170 formed on the base 10. The aperture 170 may be configured with internally-formed ribs that help secure the bobbin 31 to the base 10 when the post 370 is inserted therein. The post 370 may also be configured with shoulders that mate with the top of the aperture 170. The post-aperture combination works together with two base supports 130 and 131 to provide a three-point stance or plane between the bobbin assembly and the base assembly. The two base supports 130 and 131 protrude from the base 10 to provide bobbin support at the outer two flanges.

A strip-like movable contact spring 60 which is made from a resilient material like stainless steel, is fastened to the central part of the armature 50 by means of rivets 61 or the like (see FIGS. 7 and 8). A pair of movable contacts 62 and 63 are fixed to the ends of the movable spring 60 by welding or any other suitable method. Since the movable spring 60 is made from a metal having poor conductivity, a flexible composite copper braid 64 is welded directly between the movable contacts 62 and 63 and the movable spring 60. A second braid 65 connects the braid 64 to the movable terminal 15 to carry the load current between the movable contacts and the movable contact terminal 15.

As further shown in FIG. 1, the pole pieces 38 and 39 are provided with orientation dimples or studs 381 which render the two opposite surfaces of the pole pieces different and distinguishable. This is desirable since the pole surfaces 382 and 392 can have a rolled over edge and a break away edge. The orientation dimples and studs orientate the pole pieces during assembly; this orientation ensures that the armature will always hit the pole piece in the same relationship. Since the magnetic torque is a function of distance from the center of the pivot point to the applied magnetic force, consistent pole piece assembly will reduce the variability of the magnetic torque. Further, the orientation dimples reduce the risk of the pole pieces from sticking together during the plating operation. In order to allow the pole pieces 38 and 39 to rest against the bobbin flanges 34 and 35 also with the orientation dimples or studs 381, the end flanges 34 and 35 are provided with reliefs 342 and 352, corresponding to the respective studs of the pole pieces.

Figure 9:
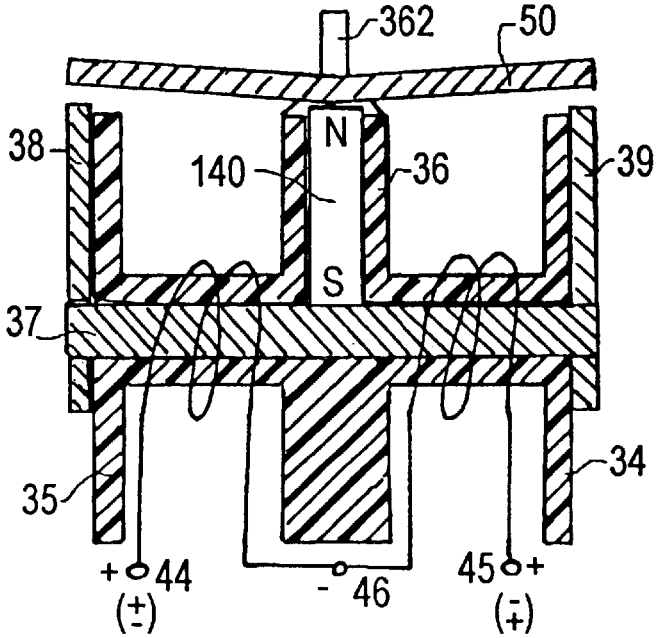
FIG. 9 is a schematic sectional view of another relay constructed in accordance with the present invention with an "E-frame" structure and a two-pole magnet.

FIG. 9 shows a schematic sectional view of another relay system of the present invention. In this relay, instead of a three-pole permanent magnet 40, a two-pole permanent magnet 140 is used which is arranged in the center flange 36 of the bobbin 31 and is coupled with one pole to the core 37, while the other pole faces the central part of the armature 50. Together with the core 37 and the pole pieces 38 and 39, this permanent magnet 140 forms a so-called "E-frame". The function, however, is the same as with the three-pole permanent magnet 40 in FIG. 1.

In operation, when the coils 32 and 33 are deenergized, the armature 50 is held or kept latched in either of the two stable positions on either one of the pole pieces 38 or 39, respectively. For moving the armature from one position to the other, a voltage pulse is applied across an appropriate coil 32 or 33 in case of a dual input wiring (see FIG. 9). In this case, the two coils 32 and 33 are wound in a common direction and have end terminals 44 and 45 as well as a common terminal 46. Armature transfer will occur by applying a voltage pulse across one of the coils 32 or 33. In case of a single input wiring, the two coils 32 and 33 are connected in series, and the center winding terminal 46 can be omitted. In this case, armature transfer will occur by toggling the voltage pulse polarity across the two coils 32 and 33 connected in series. The alternating polarity in the single input case is shown in FIG. 9 in parentheses. It is to be noted that the relay shown in FIG. 1 is energized in the same way.

The embodiments described herein are merely illustrative of the principles of the present invention. Various modifications may be made thereto by persons ordinarily skilled in the art, without departing from the scope or spirit of the invention.

What is claimed is:

1. A polarized electromagnetic relay, comprising:

an insulating base defining a bottom plane;

an electromagnet block on the base including a bobbin having a pair of end flanges and a center flange, a pair of coils each being wound about said bobbin between either one of said end flanges and said center flange, a common axis of said bobbin and coils extending parallel to said bottom plane, a core extending axially through said bobbin and coils, and a pair of pole pieces extending perpendicularly from either coil end, each adjacent to a respective end flange;

an elongate armature balanced with its central portion so as to be movable about a central rotation axis for angular movement between two contact operating positions, either end portion of the armature on either side of the rotation axis defining an air gap with one of said pole pieces;

a permanent magnet coupled magnetically between said core and said armature so as to induce the same magnetic poles in both said pole pieces and to provide an opposite pole in closely adjacent relationship to said central portion of the armature;

at least one movable contact spring fixedly connected to the armature at a portion intermediate the ends thereof and being formed with contact arms in the vicinity of either armature end portion, said contact arms carrying movable contacts to be moved according to the armature movement in and out of contact with corresponding fixed contacts mounted on said base; and a conductor connecting said contact arms with a movable contact terminal mounted on said base, wherein the armature is provided with a pair of recesses extending from either lateral side in opposite directions along the rotation axis and a pair of retaining tabs are formed on said central flange of the bobbin extending on either side of the armature, either one of the said tabs fitting in a corresponding one of said recesses of the armature and projecting beyond the armature thickness so as to limit movement of the armature in two directions as well as rotation about the rotation axis.

2. The relay as set forth in claim 1, wherein either one of said tabs has a tapered section engaging the corresponding recess of the armature, the angle of the tapered section being adapted to the angular travel of the facing edge of the recess so as to allow free rotation of the armature between its operating positions.

3. The relay as set forth in claim 1, wherein on each of said tabs a rib is provided, said rib projecting toward the lateral edge of the armature in the region of its axis of rotation for reducing the lateral friction area between the armature and the respective tab.

4. The relay as set forth in claim 1, wherein the end portions of the armature are each disposed between the bobbin and a corresponding fixed contact terminal.

5. The relay as set forth in claim 1, wherein said at least one movable contact spring is made from a material having high resilience and said conductor is made of flexible construction from a material having high conductivity.

6. The relay as set forth in claim 1, wherein said conductor comprises a composite braid, consisting of a first braid portion spanning the length between the two movable contacts and a second braid portion connecting the center of said first braid portion with the movable contact terminal.

7. The relay as set forth in claim 1, wherein said armature is H-shaped, each of its end portions defining a pair of legs with a central recess therebetween, and wherein a single contact spring is fixed on the armature so as to have a pair of contact arms each of which is arranged above either one of said recesses, each of said recesses being greater in width than the corresponding contact arm and allowing said contact arm to immerse between the armature legs when butting against a corresponding fixed contact.

8. The relay as set forth in claim 1, wherein said armature has a central section being bent slightly in a V-shape to form a fulcrum for rotating on said permanent magnet, and the end sections being bent towards said pole pieces to provide an area contact between the armature and said pole pieces.

9. The relay as set forth in claim 8, wherein said armature has grooves parallel to the rotation axis and defining bending lines between the sections which form an angle between each other.

10. The relay as set forth in claim 1, wherein said permanent magnet consists of a plate-shaped three-pole permanent magnet bridging said pair of pole pieces, said magnet being magnetized so as to have the same magnetic poles at its lengthwise ends and the opposite pole intermediate its ends.

11. The relay as set forth in claim 1, wherein said permanent magnet consists of a bar-shaped two-pole permanent magnet which is disposed in said center flange of the bobbin so as to be coupled magnetically with one pole to said core and to face with the opposite pole a central rotation axis of said armature.

12. A polarized electromagnetic relay, comprising:

an insulating base defining a base plane;

a bobbin with a pair of coils wound thereon, said bobbin having a pair of end flanges and a center flange separating said pair of coils, a core extending axially in said bobbin and parallel to the base plane and a pair of pole pieces extending perpendicularly from either end of said core;

an elongate armature balanced with its central portion to be movable about a center rotation axis for angular movement between two contact operating positions, either end portion of the armature on either side of the rotation axis defining an air gap with one of said pole pieces;

an elongate plate-shaped three-pole magnetized permanent magnet disposed between the free ends of the pole pieces in closely adjacent relationship to the armature, said permanent magnet being magnetized to have the same poles at its lengthwise ends and the opposite pole intermediate its ends;

a movable contact spring fixedly connected to the armature at a portion intermediate the ends thereof and being formed with a pair of contact arms in the vicinity of either armature end portion, each of said contact arms carrying a movable contact to be moved according to the armature movement in and out of contact with corresponding fixed contacts on fixed contact terminals mounted on said base; and a conductor connecting said movable contact with a movable contact terminal mounted on said base; wherein said armature is provided with a pair of recesses extending from either lateral side in opposite directions along the rotation axis and a pair of retaining tabs are formed on said central flange of the bobbin extending on either side of the armature, either one of said tabs fitting in a corresponding one of said recesses of the armature and projecting beyond the armature thickness so as to limit movement of the armature in two directions as well as rotation about the rotation axis.

13. The relay as set forth in claim 12, wherein said permanent magnet and said armature are arranged along a lateral side of said bobbin, said rotation axis extending perpendicular to said base plane and said fixed contact terminals each comprising a section carrying the respective fixed contact, said contact carrying sections extending also essentially perpendicular to said base plane.

14. The relay as set forth in claim 12, wherein said stationary terminals have stress concentration notches aiding adjustment of the contact distances between the stationary and movable contacts.

15. The relay as set forth in claim 12, wherein each of said stationary terminals includes a plug section and a contact carrying section both extending essentially perpendicular to said base plane, and an intermediate section extending approximately parallel to butt with a small bias angle with respect to said base plane.

16. The relay as set forth in claim 15, wherein each of said stationary terminals has a bending portion between said plug section and said intermediate section with a cutout giving a backup for the terminal when being staked into the base.

17. The relay as set forth in claim 12, wherein said permanent magnet and said core are fastened to the pole pieces by laser welding.

18. The relay as set forth in claim 12, wherein each of said plate-like pole pieces is provided with at least one orientation dimple or stud rendering its two opposite surfaces different.

19. The relay as set forth in claim 18, wherein each of said end flanges of the bobbin has at least one relief corresponding to a dimple or stud projecting from a pole piece resting against it.

20. The relay as set forth in claim 1, wherein said retaining tabs do not conduct load current.

21. The relay as set forth in claim 12, wherein said retaining tabs do not conduct load current.

* * * * *